US005584761A

United States Patent [19]

Locker

[11] Patent Number: 5,584,761

[45] Date of Patent: Dec. 17, 1996

[54] AIR DIFFUSER FOR AN AIR OUTLET

[76] Inventor: Howard W. Locker, 16630 Hidden Cove Dr., Jupiter, Fla. 33477

[21] Appl. No.: 330,965

[22] Filed: Oct. 28, 1994

[51] Int. Cl.[6] ..... F24F 13/06

[52] U.S. Cl. ..... 454/302; 454/305

[58] Field of Search ..... 454/289, 299, 454/302, 304, 305, 308, 309, 331

[56] References Cited

U.S. PATENT DOCUMENTS 2,179,893 11/1939 Lyon ..... 454/302 X
2,525,157 10/1950 Trane ..... 454/309
2,791,170 5/1957 Phillips et al. ..... 454/302 X
3,854,386 12/1974 Hedrick ..... 454/299
4,142,456 3/1979 Locker ..... 454/305

*Primary Examiner*—Harold Joyce
*Attorney, Agent, or Firm*—Gifford, Krass, Groh, Sprinkle, Patmore, Anderson & Citkowski, P.C.

[57] ABSTRACT

An air diffuser for an air outlet. The air diffuser is mounted to a ceiling or wall surface and has an inner plate member with an opening communicating with the air outlet. A plurality of nozzles extend from the inner plate member and are positioned at predetermined intervals around the periphery of the inner plate member. An outer plate member is fastened to the inner plate member so as to sandwich the nozzles therebetween.

12 Claims, 2 Drawing Sheets

AIR DIFFUSER FOR AN AIR OUTLET

BACKGROUND OF THE INVENTION

1. Field of the Invention

The present invention relates generally to air diffusers and, more particularly, to a durable air diffuser with means to sandwich a plurality of nozzle members between an inner diffuser plate and an outer diffuser plate which provides ease of assembly and installation.

2. Description of the Prior Art

Air diffusers are well known in the art. Diffusers are used when it is desirable to channel a flow of air from an air outlet of a home or business heating or air conditioning system and to re-direct the flow into a room of the home or business.

Applicant's prior U.S. Pat. No. 4,142,456 teaches an air diffuser for a ceiling or wall air outlet which distributed air flow equally in all directions into the room or enclosure. The diffuser is constructed of an inner plate, an outer plate and a plurality of nozzles arranged between and around the peripheries of the plates. The diffuser separates the flow of air from the outlet to the ambient into a plurality of diverging air jet streams by means of the nozzles which form a plurality of regularly disposed wedge shaped fins with the result that air flowing from the outlet is diffused and substantially uniformly distributed throughout a room or enclosure without causing uncomfortable drafts. The diffuser is manufactured as one piece and is constructed of a lightweight material such as aluminum.

Applicant's prior U.S. Pat. No. 4,679,495 teaches an improved air diffuser with upper and lower plates and a plurality of nozzle elements disposed therebetween and which is constructed as one piece. The nozzles separate the flow of air from the outlet to the ambient into a plurality of diverging air jet streams with the result that air flowing from the outlet is diffused and substantially uniformly distributed throughout the room or enclosure without causing uncomfortable drafts.

The present invention provides an improvement over the inventions of Applicant's previous patents by providing a construction for an air diffuser which makes the diffuser easier and less expensive to manufacture and to install.

SUMMARY OF THE PRESENT INVENTION

The present invention is an air diffuser for use with an air outlet of a home or business air treating system such as a heating system or an air conditioning system. An inner plate member is adapted to be secured to a room surface, such as a ceiling or wall. The inner plate member has an opening which communicates with the air outlet. A plurality of nozzles extend from the inner plate member and are arranged around the periphery of the inner plate member. An outer plate member is attached to the inner plate member by a plurality of fasteners and sandwiches the nozzles therebetween. The nozzles are wedge shaped and each has a narrowed inner end and an outwardly flared outer end. A plurality of tabs extend from each of the nozzles and the tabs are received in slots formed in the inner plate member to attach the nozzles to the inner plate member. The inner plate member is of a circular shape in a first preferred embodiment and mounts directly to the air outlet. The inner plate member is of a rectangular shape in a second preferred embodiment and may be mounted in the space normally occupied by a ceiling tile.

The outlets of the nozzles direct air from the air outlet of the heating or air conditioning system to the periphery of the diffuser between the inner plate member and the outer plate member.

BRIEF DESCRIPTION OF THE DRAWING

A better understanding of the present invention will be had upon reference to the attached drawings when read in conjunction with the specification, wherein like reference numerals refer to like parts throughout the several views, and in which.

DESCRIPTION OF THE PREFERRED EMBODIMENT

Figure 1:
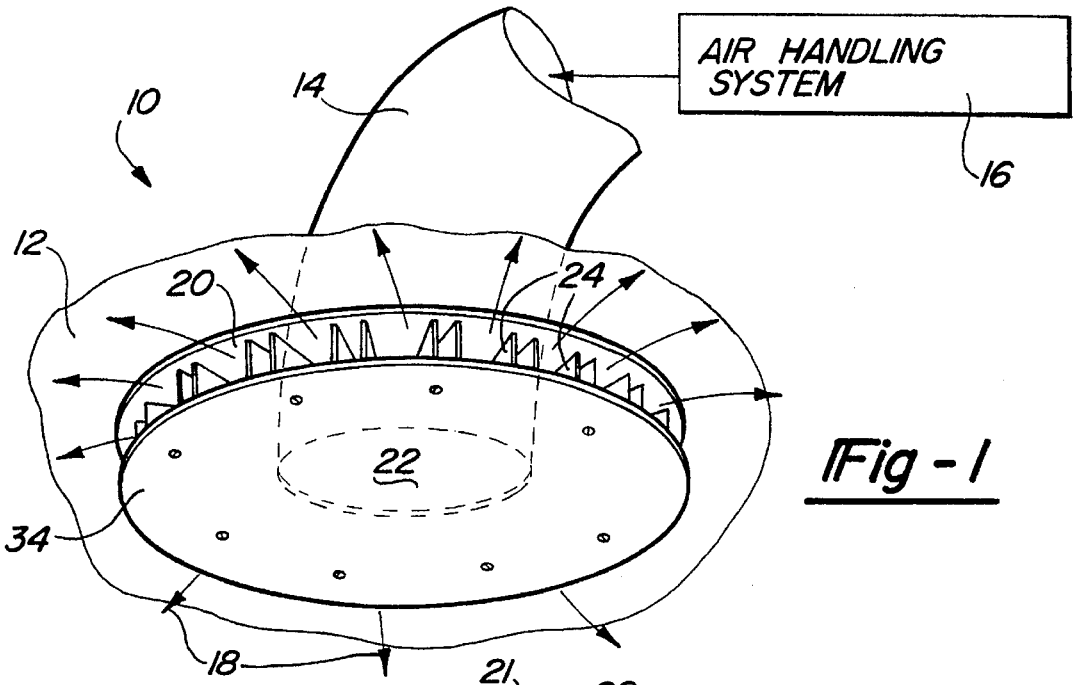
FIG. 1 is a perspective view of the air diffuser of the present invention according to a first preferred embodiment.
Figure 2:
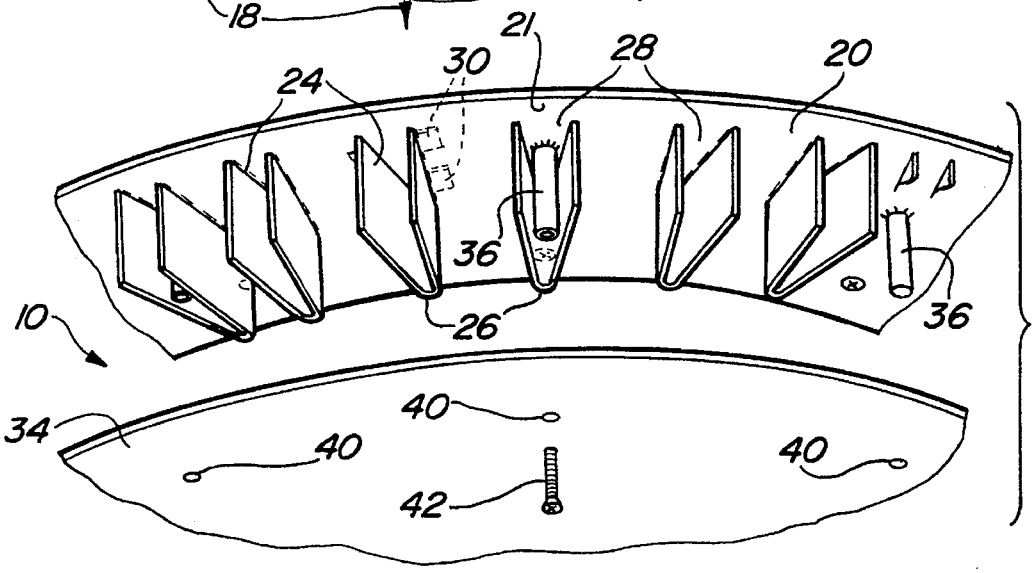
FIG. 2 is an exploded view of the air diffuser according to FIG. 1 and showing the plurality of nozzles.
Figure 4:
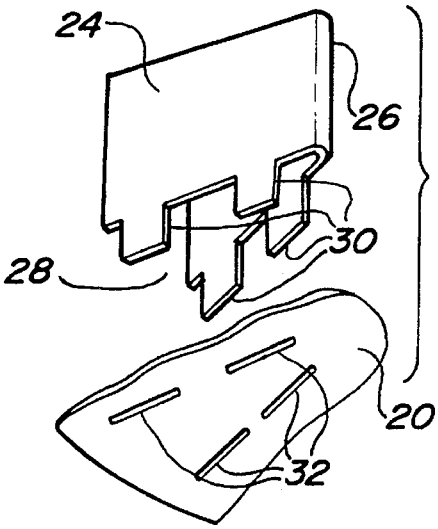
FIG. 4 is an exploded view of the tab and slot arrangement for mounting the nozzles to the inner plate member according to the embodiment of FIG. 1.
Figure 3:
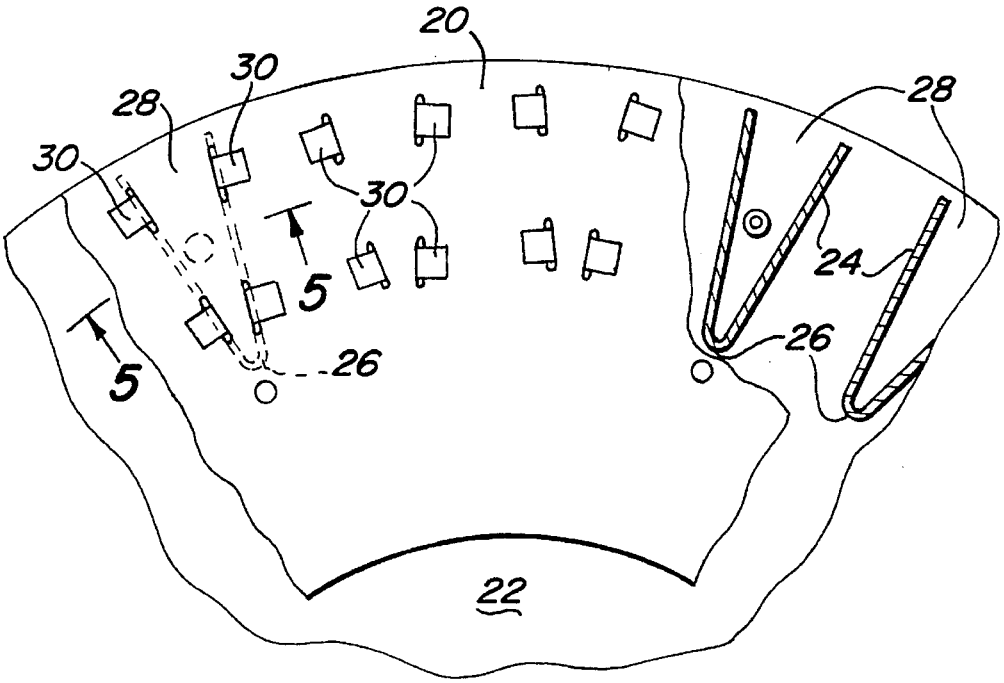
FIG. 3 is a top view of the air diffuser shown in FIG. 1 and showing the fastening of the nozzles and the inner plate member.
Figure 5:
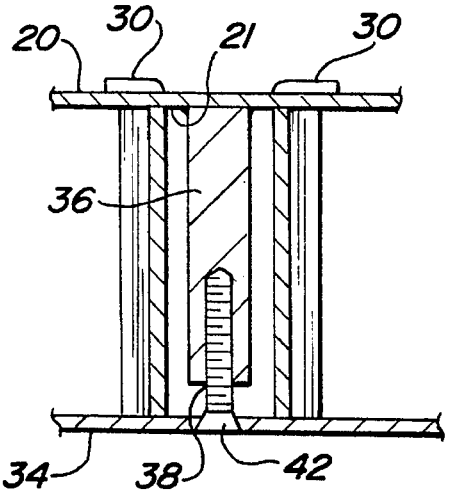
FIG. 5 is a cross sectional view taken substantially along lines 5—5 of FIG. 3 and showing the detachable mounting means for mounting the outer plate member to the inner plate member.

Referring to FIGS. 1–5, an air diffuser 10 according to a first preferred embodiment of the present invention is thereshown. The air diffuser 10 is mounted to a ceiling or wall surface 12 of a room in which the air is to be circulated and is in communication with an air outlet 14 of an air handling system 16. Currents of air 18 are directed from the air diffuser 10 as can be seen from FIG. 1.

An inner plate member 20 is secured to the wall or ceiling 12 of the room by conventional means which are known in the art such as mounting brackets or threaded mounting screws (not shown) which project from the inner plate member 20. The inner plate member 20 is constructed of a durable material such as a metal or a synthetic plastic. An opening 22 is formed in the inner plate member 20, preferably in the center of the first plate member, and is shown in phantom in FIG. 1. The inner plate member 20 is mounted to the ceiling or wall surface 12 with the opening 22 in alignment with the air outlet.

A plurality of nozzles 24 are attached to the inner plate member 20 and extend from the outer surface 21 of the inner plate member. Referring again to FIGS. 2–4, the nozzles 24 are arranged on the outer surface 21 and around the periphery of the inner plate member 20 and are spaced apart at predetermined intervals. The nozzles 24 are each constructed of a single piece of material which is angled to create a narrow inner end 26 and an outwardly-flared outer end 28. The outer ends 28 of the nozzles 24 form the outlets of the diffuser 10.

Referring again to FIGS. 3 and 4, each of the nozzles 24 has a plurality of tabs 30 which extend from the nozzles 24. The tabs 30 align with like pluralities of slots 32 which are formed through the inner plate member 20. As can be clearly shown in FIG. 3 and in phantom in FIG. 2, the tabs 30 are inserted through the slots 32 and are each bent at approximately a ninety degree angle so as to fastenably mount the nozzles 24 to the inner plate member 20.

An outer plate member 34 is mounted to the inner plate member 20 to sandwich the nozzles 24 therebetween. A plurality of sleeve members 36 extend from the outer surface 21 of the inner plate member 20 at predetermined intervals. Each of the sleeve members 36 is provided with an internally-threaded hollow outer end 38.

The outer plate member 34 has a plurality of apertures 40 formed therethrough which are aligned with the sleeve members 36 when the outer plate member 34 is placed against the outer surfaces of the nozzles 24. A like plurality of threaded screws 42 are inserted through the apertures 40 and are rotatably engaged within the internally threaded sleeve members 36 to secure the outer plate member 34 to the inner plate member 20 and to sandwich the nozzles 24 therebetween.

Figure 6:
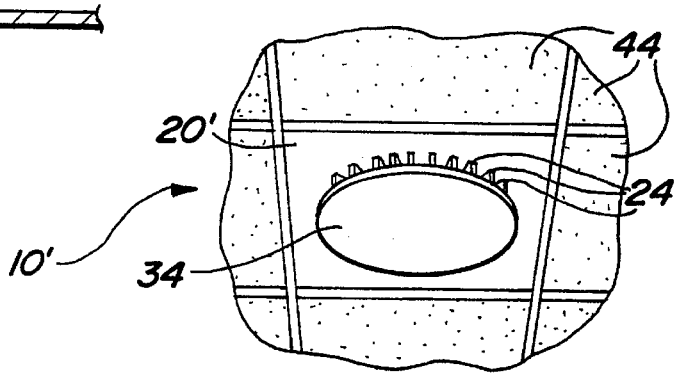
FIG. 6 is a perspective view of a second preferred embodiment of the air diffuser according to the present invention.

Referring to FIG. 6, a second preferred embodiment of the air diffuser 10' of the present invention is shown. The second preferred embodiment is identical to the first preferred embodiment in all respects, except that an inner plate member 20' is of a generally rectangular shape, rather than the generally circular shape of the inner plate member 20 shown in FIGS. 1–5. The inner plate member 20' is shaped as a rectangle so that it may be incorporated into a ceiling tile grid 44 which is commonly used in commercial structures. In this embodiment, the inner plate member 20' simply replaces one of the ceiling tiles 44 to simplify installation of the air diffuser 10' of the present invention. The outer plate member 34 is preferably of a generally circular shape in both embodiments.

It is apparent that an air diffuser has been described which in addition to the advantages of my previously disclosed diffusers has the added advantage that it can be easily manufactured and assembled. The tab and slot arrangement of the present invention provides an economical way of forming the nozzles 24 and positioning them properly between the inner and the outer plate members. Installation can be accomplished by mounting the inner plate member in place with the nozzles 24 affixed thereto and them fastening the outer plate member 34 to the inner plate member 20 to complete the installation. Since the opening 22 is in view while the inner plate member 20 is being mounted to the ceiling or the wall surface 12 alignment of the opening 22 and the air outlet 14 can be easily accomplished.

Having described my invention, other embodiments will become apparent to those skilled in the art to which it pertains without deviating from the scope of the invention as defined by the appended claims.

I claim:

1. An air diffuser for an air outlet comprising:

an inner plate member secured to a room surface and having an opening communicating with the air outlet;

a plurality of nozzles extending from said inner plate member around the periphery of said inner plate member at predetermined intervals;

an outer plate member; and means for detachably mounting said outer plate member to said inner plate member to sandwich said nozzles therebetween;

said outer plate member being removable from said inner plate member while permitting said inner plate member to remain secured to the room surface and exposing said plurality of nozzles.

2. The air diffuser as defined in claim 1, and in which each of said nozzles comprises a wedge-shaped member having a narrow inner end and an outwardly-flared outer end.

3. The air diffuser as defined in claim 2, further comprising a plurality of tabs which extend from said nozzles, said tabs being insertable through a like plurality of slots formed in said inner plate member, said tab elements being bent to secure said nozzles to said inner plate member.

4. The air diffuser as defined in claim 1, wherein said means for detachably mounting said outer plate member to said inner plate member comprises:

a plurality of internally threaded sleeve members extending from said inner plate member;

a like plurality of apertures in said outer plate member which are in alignment with said sleeve members when said outer plate member is placed over said inner plate member; and a plurality of threaded screws which are inserted through said apertures and which are rotatably engaged within said sleeve members.

5. The air diffuser as defined in claim 1, wherein said inner plate member is substantially circular in shape.

6. The air diffuser as defined in claim 1, wherein said outer plate member is substantially circular in shape.

7. The air diffuser as defined in claim 1, wherein said inner plate member is substantially rectangular in shape.

8. The air diffuser as defined in claim 1, wherein said air diffuser is constructed of a durable material.

9. The air diffuser as defined in claim 1, wherein said air diffuser is constructed of metal.

10. The air diffuser as defined in claim 1, wherein said air diffuser is constructed of synthetic plastic.

11. An air diffuser for an air outlet comprising:

an inner plate member secured to a room surface and having an opening communicating with the air outlet;

a plurality of nozzles extending from said inner plate member around the periphery of said inner plate member at predetermined intervals;

a plurality of tabs which extend from said nozzles, said tabs being insertable through a like plurality of slots formed in said inner plate member, said tabs being bent to secure said nozzles to said inner plate member;

an outer plate member; and means for attaching said outer plate member to said inner plate member to sandwich said nozzles therebetween.

12. An air diffuser for an air outlet comprising:

an inner plate member secured to a room surface and having an opening communicating with the air outlet;

a plurality of nozzles extending from said inner plate member around the periphery of said inner plate member at predetermined intervals;

an outer plate member; and means for detachably mounting said outer plate member to said inner plate member including a plurality of internally threaded sleeve members extending from said inner plate member, a like plurality of apertures in said outer plate member which are in alignment with said sleeve members when said outer plate member is placed over said inner plate member and a plurality of threaded screws which are inserted through said apertures and which are rotatably engaged within said sleeve members;

said plurality of screws being removed to permit said outer plate member to be dismounted from said air diffuser while permitting said inner plate member to remain secured to the room surface and to expose said plurality of nozzles.

* * * * *